US005509402A

United States Patent [19]

Sappington

[11] Patent Number: 5,509,402

[45] Date of Patent: Apr. 23, 1996

[54] DUAL ARCHERY SIGHT

[75] Inventor: Donald R. Sappington, St. Charles County, Mo.

[73] Assignee: Tokonics Manufacturing, Inc., Wertzville, Mo.

[21] Appl. No.: 342,875

[22] Filed: Nov. 21, 1994

Related U.S. Application Data

[63] Continuation-in-part of Ser. No. 91,911, Jul. 16, 1993, Pat. No. 5,379,746, and a continuation-in-part of Ser. No. 127,041, Sep. 27, 1993, Pat. No. 5,414,936.

[51] Int. Cl.[6] ..... F41G 1/467

[52] U.S. Cl. ..... 124/87; 33/265

[58] Field of Search ..... 124/23.1, 24.1, 124/25.6, 86, 87, 88; 33/265

[56] References Cited

U.S. PATENT DOCUMENTS

| | | | |
|---|---|---|---|
| 3,864,836 | 2/1975 | Haines | 33/265 |
| 4,020,560 | 5/1977 | Heck | 33/265 |
| 4,136,461 | 1/1979 | Gasser | 33/265 |
| 4,162,579 | 7/1979 | James | 33/265 |
| 4,417,403 | 11/1983 | Strange | 33/265 |
| 4,481,717 | 11/1984 | Kowalski | 33/265 |
| 5,001,837 | 3/1991 | Bray | 33/265 |
| 5,174,269 | 12/1992 | Sappington | 124/87 |

*Primary Examiner*—John A. Ricci
*Attorney, Agent, or Firm*—Paul M. Denk

[57] ABSTRACT

An archery bow sight is provided which is mountable to an archery bow. The bow sight includes a bow sight mounting, a pin sight secured to one side of the mounting, and a scope sight secured to another, opposite side of said mounting. The mounting is pivotally mounted to the bow so that an archer may quickly and easily switch between the two different sights.

14 Claims, 3 Drawing Sheets

DUAL ARCHERY SIGHT

CONTINUING APPLICATION

This is a continuation-in-part of application Ser. No. 08/091,911, filed Jul. 16, 1993 now U.S. Pat. No. 5,379,746 and a continuation in part of application Ser. No. 08/127,041, filed Sep. 27, 1993, now U.S. Pat. No. 5,414,936 both of which are incorporated herein by reference.

BACKGROUND OF THE INVENTION

This invention relates to archery sights, and in particular to archery sights for use in 3-D target shooting.

Three dimensional archer contests are typically held outside in natural conditions. It may be clear during the contest, or it may be cloudy, rainy or foggy. If the archer is using a scope in rainy conditions, the scope may cloud up and become unusable. If the contest is being held under very sunny conditions, the bright sun may affect the scope. In these conditions, it is more desirable to use a pin sight rather than a scope sight. However, this requires that the scope be removed from the bow and a pin sight placed on the bow in its stead. The sight will then have to be adjusted to ensure that it is properly calibrated. This of course is a tedious process which can take a considerable amount of time.

SUMMARY OF THE INVENTION

One object of the present invention is to provide an archery sight which allows for quick and easy switching between a scope sight and a pin sight.

Another object is to provide such a sight which includes both a scope and a pin sight.

Another object is to provide such a sight which does not need to be recalibrated each time the sight is changed.

Another object is to provide such a sight which is easy to use and economical to produce.

These and other objects will become apparent to those skilled in the art in light of the following disclosure and accompanying drawings.

In accordance with the invention, briefly stated, an archery bow sight of the present invention is mountable to an archery bow. The bow sight includes a bow sight mounting, a pin sight secured to one side of the mounting, and a scope sight secured to another, opposite side of said mounting. The mounting is pivotally mounted to the bow so that the pin sight and bow sight may be selectively switched by rotating the mounting 180°. The mounting is secured to a generally vertical support. A nose extends outwardly from the support and the mounting is rotatably journaled on the nose. The nose is at least partially threaded and receives a lock nut used to secure the mounting in place. When the lock nut is loosened, the position of the pin sight and scope sight can be switched to quickly and easily switch between the two different scopes. The mounting block preferably has a beveled back surface which mates with a groove formed in the support to maintain proper vertical alignment of the mounting block upon rotation of the block.

DESCRIPTION OF THE PREFERRED EMBODIMENT

Figure 1:
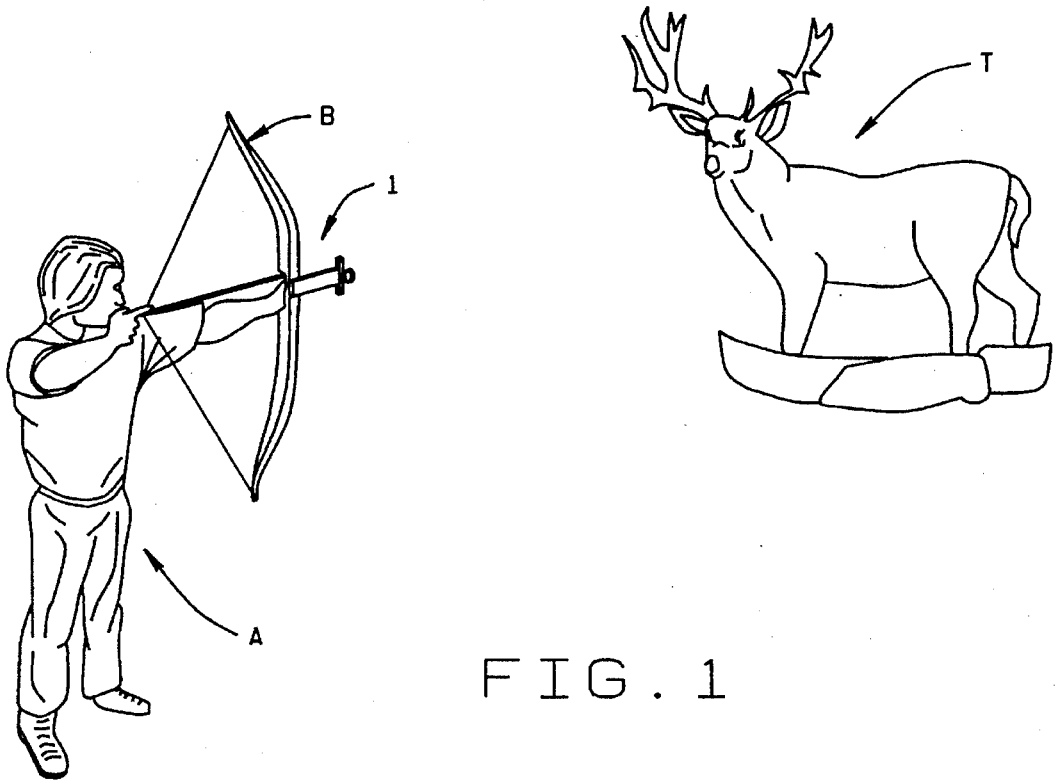
FIG. 1 is a perspective view of an archer aiming at a three dimensional target.
Figure 3:
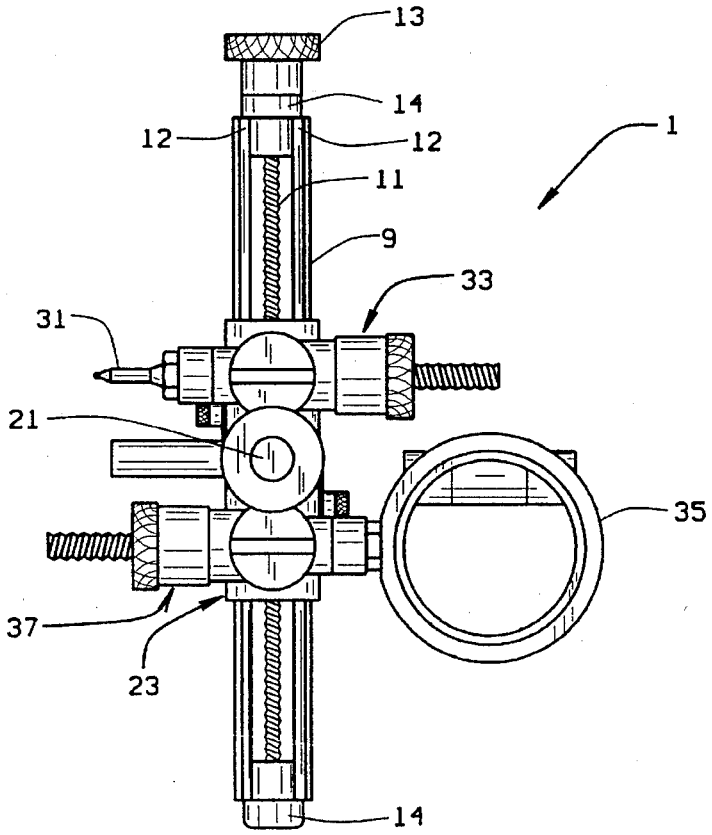
FIG. 3 is a front elevational view of the bow sight.
Figure 2:
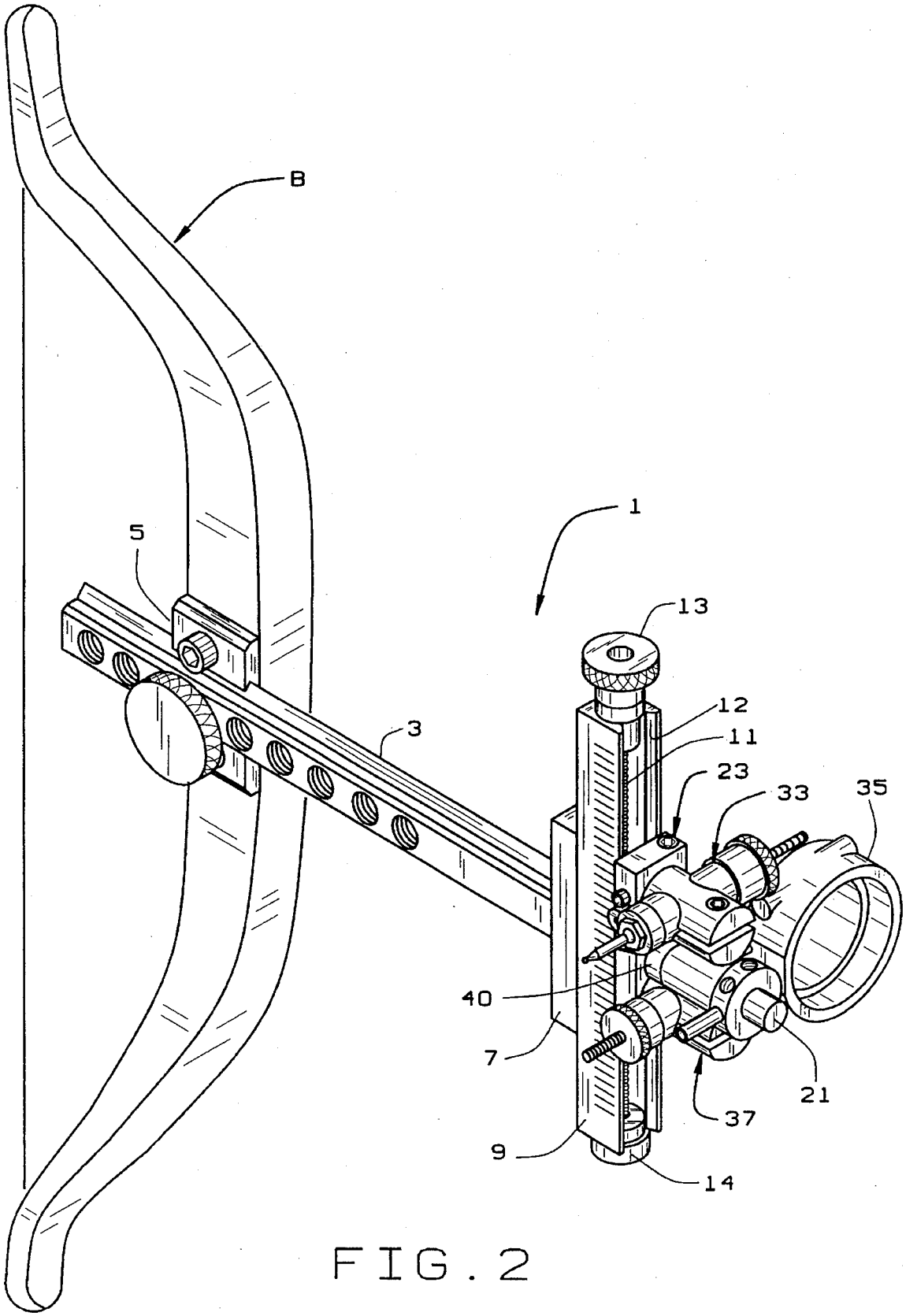
FIG. 2 is a perspective view of a bow sight of the present invention mounted on a bow.
Figure 4:
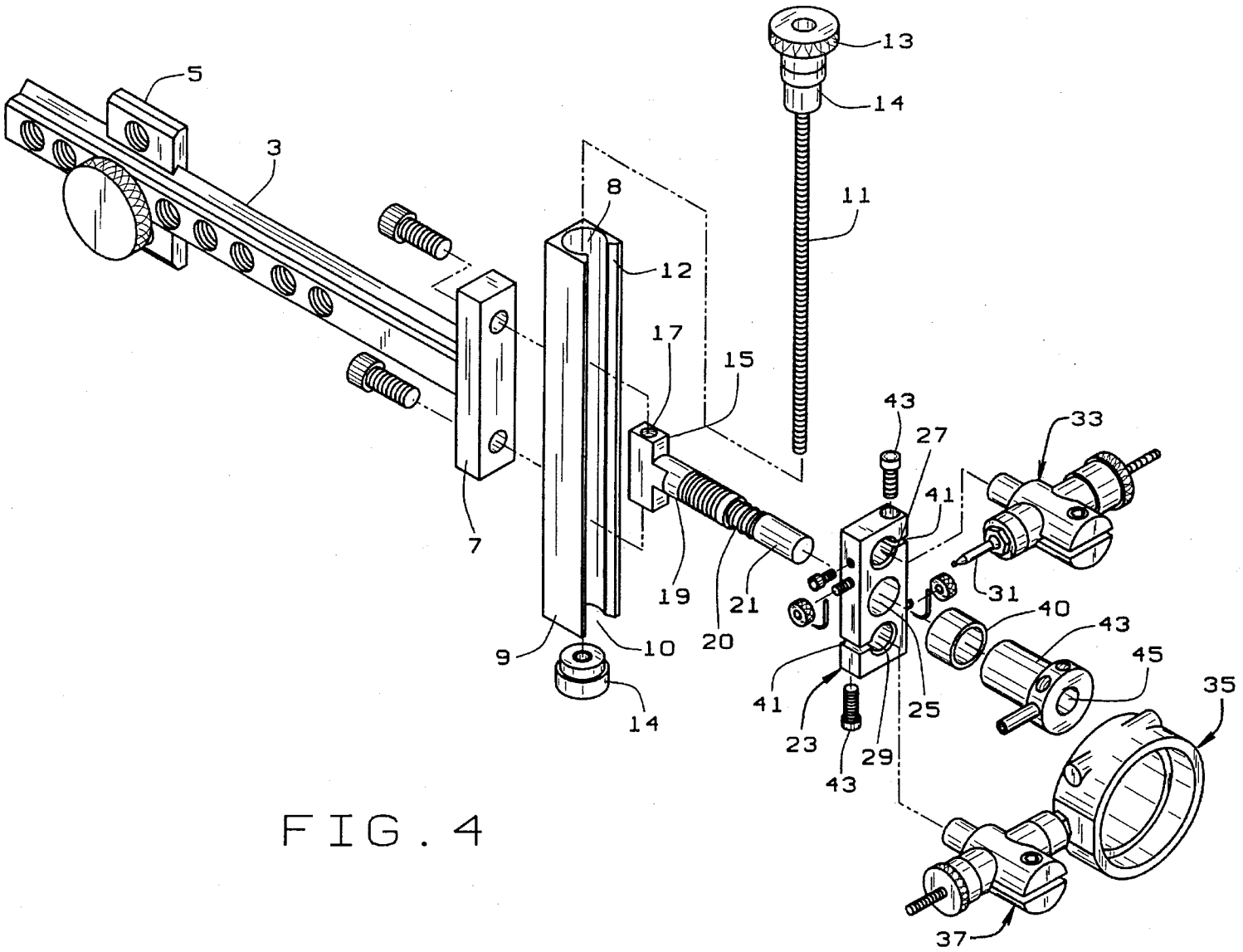
FIG. 4 is an exploded view of the sight.

An archer A is shown in FIG. 1 aiming an archery bow B at a three dimensional target T, which is shown in the form of an elk. A bow sight 1 of the present invention is mounted to bow B. Sight 1, shown in detail in FIGS. 2–4, is mounted to an arm 3 which is secured in a base 5 mounted to bow B. The mounting base 5 may be such as I described in my U.S. Pat. No. 5,379,746, which is incorporated herein by reference.

A vertical block 7 is secured to the end of mounting arm 3 to mount a generally vertical slide 9 to arm 3. The construction and operation of slide 9 is similar to the slide I disclose in my U.S. Pat. No. 5,414,936, which is also incorporated herein by reference. Slide 9 defines a generally cylindrical-like passage 8 having an axial opening 10 extending the length of slide 9. The edges 12 of opening 10 are preferably beveled, as described in my above mentioned applications. A threaded rod 11 is rotatably mounted in slide 9 within passage 8. Preferably, the shaft is rotatably journaled through upper and lower bearings 14 to mount the rod in slide 9. The rod extends through the upper journal. A knurled knob 13 is provided at the top of rod 11 to allow the archer to rotate the rod.

A block 15 having a threaded bore 17 receives threaded bar 11. When threaded bar 11 is rotated, the threads of bar 11 cooperate with the threads of bore 17 to came the block 15 to move vertically along slide 9. A threaded, hollow nose 19 extends forwardly of block 15. A pin 21, biased outwardly by a spring 20, is received in nose 19 and is operable, as described in my above noted applications, to allow for gross adjustment of the position of the block 15 along slide 9.

An elongate sight mounting block 23 is received on nose 19. Block 23 includes a central opening 25 sized to fit over nose 19 and to allow rotation of block 23 about nose 19. Upper and lower openings 27 and 29 are spaced above and below opening 25. Preferably, the centers of openings 27 and 29 are equidistant from the center of opening 25. The back of block 23 has axially extending beveled edges (not shown) which correspond to the bevels 12 of slide 9, as described in my aforementioned applications. The interaction of the beveled surfaces, as discussed therein, allows of the relative horizontal positions of the block 23 and slide 9 to be the same, even though the vertical or rotational orientation of the block may change.

A pin sight 31 is mounted in a peg 33 which, in turn, is received in opening 27. A scope sight 35 is mounted in a peg 37 which, in turn, is received in opening 29. Gaps 41 are formed in the side walls of openings 27 and 29. Screws 43 extend through the gap and can be tightened to close the gaps 41 to frictionally secure the pegs 33 and 37 in their respective openings, to secure the sights 31 and 35 in block 23. The structure of pegs 33 and 37 allow for horizontal adjustment of the sights' position, as described in my above noted applications.

Sights 31 and 35 are mounted to block 23 to extend oppositely from each other. Sight 31 extends outwardly from one side (i.e. the left side) of the block and sight 35 extends outwardly from the other side (i.e. the right side) of the block, as best shown in FIGS. 2 and 3. Thus, when one sight is in position to be used, the other sight is out of the way. In the drawings, the scope sight is shown in position for use. If the archer would rather use the pin sight, he need only rotate the block 23 180° to place the pin sight in position for use.

A spacer 40 is received about nose 19 and abuts an outer or forward surface of mounting block 23. A lock nut 43 having a threaded bore 45 is threadably received on nose 19 to abut spacer 40. The threads of nut 43 are positioned in bore 45 to engage the threads of nose 19 of slide block 15. By tightening nut 43 against spacer 40, block 23 is urged against the slide 9 so that the beveled edges of block 23 and slide 9 create an interference fit to prevent rotation of block 23 about nose 19. Preferably, nut 43 will be tightened down so that mounting block 23 will be frictionally fixed against both vertical and pivotal movement, so that the sight will remain still and will not wobble in the slide. If conditions change, and the archer desires to switch sights used, he merely loosens nut 43 sufficiently to allow the block 23 to rotate around nose 19. This requires that the lock nut 43 be loosened sufficiently to allow the beveled edges of block 23 to clear the beveled edges 12 of slide 19. He then rotates the block 180° to move the other sight into position for use. Once the mounting block has been rotated, and the desired scope is in position, lock nut 43 is tightened to secure the sight 1 in the desired position. Because the sights are spaced equally from center opening 25, no adjustment of the sight is needed to align the sight. Further, as described in my above noted application, the block 23 cooperates with the slide 9 so that when the lock nut is tightened, the horizontal position of the block 23 with respect to the slide 9 is the same. This will enable the archer to quickly change the sight used without the need to recalibrate each sight each time it the sight changed, as is currently required. As can be appreciated, this can substantially decrease the time needed for an archer to switch between a scope sight and a pin sight during an archery session.

The foregoing description is set forth for illustrative purposes only, and is not intended to be limiting. Variations within the scope of the appended claims will be apparent to those skilled in the art in light of the foregoing description and accompanying drawings. For example, the sights could be mounted in other manners, such as by mounting them directly to the block instead of using pegs 33 and 37. Because the sights will be calibrated separately from each other, it is not even necessary that they be spaced equally from the central opening of the block. Although the spacer is preferably used with the lock nut, it may be omitted from the sight. These examples are illustrative only.

I claim:

1. An archery bow sight mountable to an archery bow, the bow sight including a bow sight mounting, a pin sight secured to one side of said mounting, and a scope sight secured to another side of said mounting; said bow sight mounting being pivotally mounted to said bow so that said pin sight and said scope sight may be selectively interchanged.

2. The archery bow sight of claim 1 wherein said sight mounting is secured to a generally vertical support, said support including a forwardly extending nose, said sight mounting having a bore extending therethrough, said sight mounting being rotatably journaled about said nose; the sight further including a lock to lock said sight mounting in a desired position.

3. The archery bow sight of claim 2 wherein said nose is at least partially threaded, said lock including a lock nut which bears against said sight mounting to lock said sight mounting in position.

4. The archery bow sight of claim 3 wherein said sight mounting has a rear surface having a beveled edge; said vertical support having a front surface defining a groove, said groove having a beveled edge; said mounting beveled surface mating against said vertical support beveled edge to facilitate vertical alignment of said sight mounting, said beveled surfaces creating an interference fit when said lock nut is tightened to prevent pivoting of said sight mounting with respect to said vertical support.

5. The archery bow sight of claim 3 including a spacer journaled on said rod between said sight mounting and said lock nut.

6. The archery bow sight of claim 3 wherein said sight mounting bore is vertically centrally positioned on said mounting, said scope site being secured to said mount on one side of said bore and said pin sight being secured to said mount on a second side of said bore, such that said pin sight and scope sight extend in opposite directions from said sight mounting bore.

7. The archery bow sight of claim 6 wherein said pin sight and said scope sight are each secured in a sight base, said pin sight base and said scope sight base having centers equidistant from said sight mounting bore.

8. A dual archery sight, the sight including a mounting block pivotally secured to an archery bow, a pin sight mounted to said block to extend horizontally from said block in one direction, a scope sight mounted to said block to extend horizontally from said block in a second direction, and a lock to lock said dual archery sight in a desired rotational orientation, said dual archery sight being operable to change the sight used without removing either of said pin sight or said scope sight from said bow.

9. The dual archery sight of claim 8 including a slide secured to said archery bow, said slide receiving a slide block, said slide block having a forwardly extending nose; said mounting block being pivotally mounted about said nose.

10. The dual archery sight of claim 9 wherein said nose is at least partially threaded, said nose receiving a lock nut, said mounting block being positioned between said slide block and said lock nut, said lock nut being tightened against said mounting block to lock said mounting block in a desired position.

11. The dual archery sight of claim 10 wherein said slide has a groove extending substantially the length of a forward edge of said slide, said groove being defined at least in part by vertical beveled edges; said mounting block having beveled edges which interact with said slide beveled edges to maintain vertical alignment of said mounting; said beveled edges of said slide and said beveled edges of said mounting interfering with each other when said lock nut is tightened to prevent pivotal motion of said mounting with respect to said slide.

12. The dual archery sight of claim 11 wherein said slide block nose is sufficiently long, and said lock nut can be loosened sufficiently to prevent said slide beveled edges from interfering with said sight mounting beveled edges to allow rotation of said sight mounting about said slide mounting nose.

13. The dual archery sight of claim 9 wherein said scope sight and said pin sight are secured to said mounting block to be on opposite sides of said nose.

14. The dual archery sight of claim 13 wherein said scope sight and said pin sight are mounted to said mounting block equidistant from said slide block nose.

* * * * *

UNITED STATES PATENT AND TRADEMARK OFFICE

CERTIFICATE OF CORRECTION

PATENT NO. : 5,509,402
DATED : April 23, 1996
INVENTOR(S) : Donald R. Sappington It is certified that error appears in the above-indentified patent and that said Letters Patent is hereby corrected as shown below:

Title page, item [73], Assignee: should read -- Toxonics--.

Change Assignee's address to --Wentzville--.

Signed and Sealed this
Thirtieth Day of July, 1996

*Attest:*

*Attesting Officer*

Bruce Lehman

BRUCE LEHMAN

*Commissioner of Patents and Trademarks*